US011864583B1

(12) United States Patent
Almonte

(10) Patent No.: US 11,864,583 B1
(45) Date of Patent: Jan. 9, 2024

(54) METHOD AND APPARATUS FOR A SMOKING SHELL WITH A REINFORCING TIP HAVING A VISIBLE V-SHAPED BLOCKING ELEMENT

(71) Applicant: IP TRADEMARK HOLDINGS INC, Mandeville, LA (US)

(72) Inventor: Pedro Almonte, Santiago (DO)

(73) Assignee: IP Trademark Holdings, Inc., Mandeville, LA (US)

( * ) Notice: Subject to any disclaimer, the term of this patent is extended or adjusted under 35 U.S.C. 154(b) by 0 days.

(21) Appl. No.: 18/303,006

(22) Filed: Apr. 19, 2023

(51) Int. Cl.

| | |
|---|---|
| ***A24D 1/02*** | (2006.01) |
| ***A24D 1/00*** | (2020.01) |
| ***A24D 1/04*** | (2006.01) |

(52) U.S. Cl.
CPC ..... *A24D 1/022* (2013.01); *A24D 1/006* (2013.01); *A24D 1/04* (2013.01)

(58) Field of Classification Search
None
See application file for complete search history.

(56) References Cited

U.S. PATENT DOCUMENTS

| | | | |
|---|---|---|---|
| 1,631,048 | A | 5/1927 | Miller |
| 3,640,287 | A | 2/1972 | Pinkham |
| 6,742,525 | B2 | 6/2004 | Sinclair, Jr. |
| 6,854,471 | B1 | 2/2005 | Sinclair, Jr. |
| D526,086 | S | 8/2006 | Mehta |
| 7,377,281 | B2 | 5/2008 | Bachmann |
| 9,072,319 | B2 | 7/2015 | Kesselman |
| 9,179,706 | B2 | 11/2015 | Jespersen et al. |
| 10,212,965 | B2 | 2/2019 | Sinclair, Jr. et al. |
| 10,905,153 | B1 | 2/2021 | Sinclair, Jr. |
| 11,076,632 | B1 | 8/2021 | Ormaza |
| D947,682 | S | 4/2022 | Shade |
| 11,304,441 | B1 | 4/2022 | Sinclair, Jr. |
| 11,311,044 | B2 | 4/2022 | Shoor et al. |
| 11,369,137 | B1 | 6/2022 | Wahidi |
| 11,395,508 | B1 | 7/2022 | Wahidi |
| 11,395,509 | B1 | 7/2022 | Wahidi |

(Continued)

FOREIGN PATENT DOCUMENTS

EP 3308659 A1 * 4/2018 ..... A24D 3/0229

OTHER PUBLICATIONS

Dutch Headshop, "Joint Filter Tip Designs Tutorial with Pictures", undated. https://www.dutch-headshop.eu/blog/joint-filter-tip-designs-tutorial (Year: 2023).*

*Primary Examiner* — Michael J Felton
(74) *Attorney, Agent, or Firm* — Roy Kiesel Ford Doody & North, APLC; Brett A. North

(57) ABSTRACT

A smoking product and method of making thereof for the consumption of a smokable substance. The product has a hollow conical shape that allows for the easy insertion of smokable substances. Additionally, the conical or frusto-conical shape of the product provides for larger amounts of smokable substances in the end of the product the consumer lights, resulting in an initial slower prolonged burn. Additionally, the product includes a supporting filter tip with v-shaped visual indicator contained therein and is packaged for sale in packaging in an unfilled state allowing a user to remove the product from the packaging, fill it with the user's selected custom smokable filler and form a custom smoking product.

27 Claims, 9 Drawing Sheets

(56) References Cited

U.S. PATENT DOCUMENTS

| | | | | |
|---|---|---|---|---|
| 2007/0068543 | A1 | 3/2007 | Chen | |
| 2016/0088871 | A1* | 3/2016 | Sinclair, Jr. ..... | A24D 1/022 131/365 |
| 2020/0352216 | A1 | 11/2020 | Shade | |

* cited by examiner

METHOD AND APPARATUS FOR A SMOKING SHELL WITH A REINFORCING TIP HAVING A VISIBLE V-SHAPED BLOCKING ELEMENT

BACKGROUND OF THE INVENTION

The present invention relates to smoking articles such as preformed conical smoking shells. More particularly, the present invention relates to an improved preformed conical smoking shell, packaged for sale in an unfilled state and having a reinforcing tip with at least three folded panels, wherein, when viewed from below, having two visible edges from the folded panels forming a "V-shaped" blocking element, and the remaining edges from the additional folded panels being rendered substantially non-visible. Such visible "V-shaped" blocking element increases the aesthetic appearance of the preformed smoking shell.

Many smokers prefer to use their own smokable filler product as opposed to purchasing cigars that are already constructed and filled with a manufacturer's selection of smokable filler. These users of fine, custom smokable filler prefer to start with an empty preformed conical smoking shell ,which they prefer to purchase, and then fill it with their own custom smokable filler after the conical smoking shell has been removed from its package.

SUMMARY OF THE INVENTION

Various embodiments relate generally to products for the consumption smokable substances, and more particularly to a product and method of making thereof for the consumption of smokable substances having a hollow conical or frustoconical shell which includes a reinforcing tip having a visible "V" formed from the lower edges of a plurality of folded panels. Such visible "V" is aesthetically pleasing to consumers and provides a differentiating mark for the conical smoking shell.

In various embodiments the conically or frustoconically shaped smoking shell has an outer surface, a large diameter end, a small diameter end, and a cavity that extends from the large diameter end to the small diameter end.

Various embodiments relate generally to products and methods of making thereof, for consumption of smokable filler such as herbs and other smokable substances.

In various embodiments is provided a product that is easy to use and provides for a superior smoke.

In various embodiments is provided a method of making a conical smoking shell for the consumption of smokable substances resulting in a product that is easy to fill and finish, and provides for a consistent quality smoke.

In various embodiments is provided packaging for packaging the hollow conical smoking shell. In various embodiments the packaging can be a container, pouch, a bag, a flexible wrapper, or a tube.

In various embodiments is provided an elongated member for packing or tamping smokable substances into the hollow conical smoking shell when packaged for sale.

In various embodiments is provided a product for smoking smokable filler, herbs, and other smokable substances, comprising:

a hollow cone having a hollow cone longitudinal axis, a first end defining a larger cone opening perimeter, and a second end defining a smaller first cone opening perimeter, whereby the larger cone opening perimeter has a diameter greater than the diameter of the smaller cone opening perimeter, whereby a line spanning between the larger and smaller cone opening perimeters has a slope and length; and a cone interior being defined by a space between the larger cone opening perimeter and the smaller cone opening perimeter.

In various embodiments is provided a reinforcing tip for use in a smokable article, the reinforcing tip comprising:

(a) a sheet having first and second sections, wherein the first section is rolled with top and bottom portions, and having a reinforcing tip interior and a longitudinal centerline;

(b) the second section is located in the reinforcing tip interior and includes at least four folded panels, each of the at least four folded panels having top and bottom panel edges, wherein a first two of the at least four folded panels are both directly attached to each other and have bottom panel edges which are both substantially perpendicular to the longitudinal centerline and located substantially at a first vertical level, wherein a second two of the at least four folded panels which are not the first two of the at least four folded panels satisfy at least one of the following conditions:

(1) having bottom panel edges that are not substantially perpendicular to the longitudinal centerline;

(2) having bottom panel edges which are both not located substantially at the first vertical level; and (3) having one bottom panel edge that is not substantially perpendicular to the longitudinal centerline and another bottom panel edge which is not located at the first vertical level.

In various embodiments is provided a product for smoking smokable filler, herbs, and other smokable substances, comprising a reinforcing tip having:

(a) a sheet having first and second sections, wherein the first section is rolled with top and bottom portions, and having a filter tip interior and a longitudinal centerline;

(b) the second section is located in the filter tip interior and includes at least four folded panels, each of the at least four folded panels having top and bottom panel edges, wherein a first two of the at least four folded panels are both directly attached to each other and have bottom panel edges which are both substantially perpendicular to the longitudinal centerline and located substantially at a first vertical level, wherein a second two of the at least four folded panels which are not the first two of the at least four folded panels satisfy at least one of the following conditions:

(1) having bottom panel edges that are not substantially perpendicular to the longitudinal centerline;

(2) having bottom panel edges which are both not located substantially at the first vertical level; and (3) having one bottom panel edge that is not substantially perpendicular to the longitudinal centerline and another bottom panel edge which is not located at the first vertical level.

In various embodiments is provided a packaged conical smoking apparatus that generates a smokable article, comprising:

a) a package having an interior and an end portion with a sealed opening;

b) a conical smoking shell being hollow and conically shaped with a shell interior and a longitudinal shell centerline;

c) a reinforcing tip that occupies a position within the shell interior, the reinforcing tip having a stiffness that is greater than the stiffness of the conical smoking shell;

d) wherein the reinforcing tip has a plurality of transversely oriented panels forming a plurality of pathways through the reinforcing tip and a frangible capsule oriented between a selected two of the plurality of transversely oriented panels e) wherein a first two of the transversely oriented panels are both directly attached to each other and have bottom panel edges which are both substantially perpendicular to the longitudinal centerline and located substantially at a first vertical level, f) wherein a second two of the transversely oriented panels which are not the first two of the transversely oriented panels satisfy at least one of the following conditions:

(1) having bottom panel edges that are not substantially perpendicular to the longitudinal shell centerline;

(2) having bottom panel edges which are both not located substantially at the first vertical level; and (3) having one bottom panel edge that is not substantially perpendicular to the longitudinal shell centerline and another bottom panel edge which is not located at the first vertical level;

g) wherein the conical smoking shell and reinforcing tip are packaged inside the package interior as an assembly.

In various embodiments is provided a packaged conical smoking apparatus that generates a smokable article, comprising:

a) a package having an interior and an end portion with a sealed opening;

b) a conical smoking shell being hollow and conically shaped with a shell interior and a longitudinal shell centerline;

c) a reinforcing tip that occupies a position within the shell interior, the reinforcing tip having a stiffness that is greater than the stiffness of the conical smoking shell;

d) wherein the reinforcing tip has a plurality of transversely oriented panels forming a plurality of pathways through the reinforcing tip and a frangible capsule oriented between a selected two of the plurality of transversely oriented panels e) wherein a first two of the transversely oriented panels are both directly attached to each other and have bottom panel edges which are both substantially perpendicular to the longitudinal centerline and located substantially at a first vertical level, f) wherein a second two of the transversely oriented panels which are not the first two of the transversely oriented panels satisfy at least one of the following conditions:

(1) having bottom panel edges that are not substantially perpendicular to the longitudinal shell centerline;

(2) having bottom panel edges which are both not located substantially at the first vertical level; and (3) having one bottom panel edge that is not substantially perpendicular to the longitudinal shell centerline and another bottom panel edge which is not located at the first vertical level;

g) wherein bottom panel edges of the first two of the at least four folded panels form a V-shape; and h) wherein the conical smoking shell and reinforcing tip are packaged inside the package interior as an assembly.

In various embodiments the bottom panel edges of the first two of the at least four folded panels of the reinforcing tip form a V-shape which is clearly visibly distinguishable compared to the bottom edges of the remainder of the at least four folded panels.

In various embodiments, the first section of the reinforcing tip forms a closed conical shape, the second section has at most four folded panels, and the reinforcing tip is located in a conical smoking sheet.

In various embodiments, the first section of the reinforcing tip includes first and second side edge portions, and is rolled so that the first side edge portion overlaps and extends over the second side edge portion to for a closed conical shape.

In various embodiments, the first section of the reinforcing tip has a length and a height, and at least 25 percent of the length overlaps and extends over the second side edge portion.

In one embodiment, the first section of the reinforcing tip has a length and a height, and at least 50 percent of the length overlaps and extends over the second side edge portion.

In various embodiments, the bottom panel edges of the second two of the at least four folded panels of the reinforcing tip are not located at the first vertical level.

In various embodiments, the bottom panel edges of the second two of the at least four folded panels of the reinforcing tip are located in a common plane.

In various embodiments, the bottom panel edges of the second two of the at least four folded panels of the reinforcing tip are located in a common plane that is perpendicular to the longitudinal shell centerline.

In various embodiments, the bottom panel edges of the second two of the at least four folded panels of the reinforcing tip are located in a common plane that is skewed in relation to the longitudinal centerline.

In various embodiments is provided a packaged conical smoking apparatus that generates a smokable article, comprising:

a) a package having a package interior and an end portion with a sealed opening;

b) a smokable cone being hollow with a cone interior and cone sidewall;

c) a reinforcing tip having a tip interior, the reinforcing tip occupying a position within the cone interior, the reinforcing tip having a stiffness that is greater than the stiffness of the cone sidewall;

d) wherein, the reinforcing tip has a plurality of transversely oriented panels forming a plurality of pathways through the tip interior;

e) wherein, each of the panels in the plurality of transversely oriented panels have upper and lower panel edges, wherein the upper panel edges of each of the plurality of transversely oriented panels being substantially located in a common upper plane, and further two of the plurality of transversely oriented panels immediately adjacent each other having lower panel edges being substantially located in a common lower plane and the lower panel edges forming a main V-shape, and further at least one other of the plurality of transversely oriented panels having a lower panel edge not substantially located in the common lower plane; and f) wherein the smokable cone is packaged for sale inside the package interior as an assembly.

In various embodiments the reinforcing tip includes at least 4, 5, or 6 transversely oriented panels which are connected to each other in series at a plurality of spaced apart vertices and only two of the at least 4, 5, or 6 transversely oriented panels have lower panel edges that are substantially located in the common lower plane.

In various embodiments, the at least one other of the plurality of transversely oriented panels having a lower panel edge substantially located in a first medial plane that is parallel to the common lower plane and spaced between the common upper plane and common lower plane.

In various embodiments, the at least one other of the plurality of transversely oriented panels having a lower panel edge substantially located in a second medial plane that intersects both the common lower plane and the common upper plane and common lower plane.

In various embodiments, the at least one other of the plurality of transversely oriented panels having a lower panel edge substantially located in a first medial plane that is parallel to the common lower plane and spaced between the common upper plane and common lower plane, and at least one other of the plurality of transversely oriented panels having a lower panel edge substantially located in a second medial plane that intersects both the common lower plane and the common upper plane and common lower plane.

In various embodiments, the at least one other of the plurality of transversely oriented panels having a lower panel edge substantially located in a first medial plane that is parallel to the common lower plane and spaced between the common upper plane and common lower plane, and at least one other of the plurality of transversely oriented panels having a lower panel edge substantially located in a second medial plane that is parallel to and spaced apart from the first medial plane.

In various embodiments, the at least one other of the plurality of transversely oriented panels includes at least two panels having lower panel edges substantially located in a first medial plane that is parallel to the common lower plane and spaced between the common upper plane and common lower plane.

In various embodiments, a push rod or tamper can be included in with the smokable shell. In various embodiments, the push rod can be nested inside the smokable shell.

In various embodiments the conical smokable shell can be comprised of smokable materials chosen from any combination of the following materials: natural leaf, homogenized tobacco paper, pipe tobacco, different types of flavored tobacco, cellulose (clear, opaque, or colored), bleached or non-bleached paper, cigarette paper, rice paper, herbal materials, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, hemp, Hemia salicifolia, Kava Kava, Avena Sativa, scotch broom topps, Valarian, capillarius, herba, Wild clip dagga, Leonurus sibiricus, Kanna, Sinicuichi, chocolate, herbal components, and/or lactuca virosa.

In various embodiments smokable filler material can be selected from any combination of the following types of filler material: smoking tobacco, pipe tobacco, different types of flavored tobacco, herbal materials, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, Hemia salicifolia, Kava Kava, Avena Sativa, scotch broom topps, Valarian, capillarius, herba, Wild clip dagga, Leonurus sibiricus, Kanna, Sinicuichi, and/or lactuca virosa.

In various embodiments the conical smoking shell, filter tip, and/or smokable filler can include liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, piña colada, punch, purple, rum, strawberry/kiwi, vanilla, watermelon, wet cherry, and/or whiskey. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF DESCRIPTION OF DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Various embodiments relate generally to products for the consumption smokable substances, and more particularly to a product and method of making thereof for the consumption of smokable substances having a hollow conical or frustoconical shell which includes a reinforcing tip having a visible "V" on its lower end.

Formation of a Visible "V"

Figure 17:
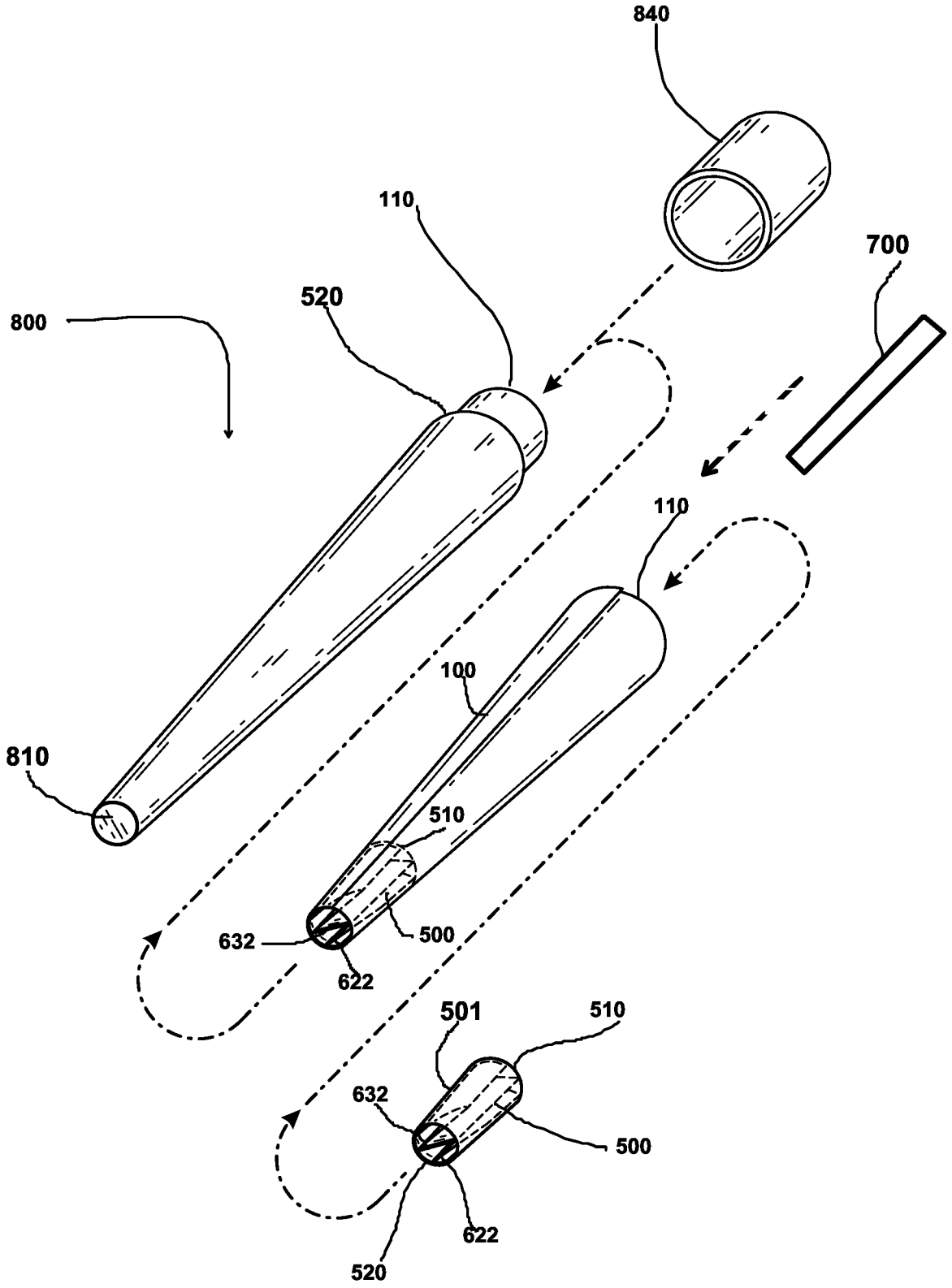
FIG. 17 is a perspective view of the conical smoking shell of FIG. 16 where the reinforcing tip of FIG. 6 is schematically shown as being placed in the interior of the conical smoking shell and the conical smoking shell is schematically shown as being packaged for sale.

FIG. 17 is a perspective view of a conical smoking shell 100 where the reinforcing tip 500 includes an emphasized or visible "V" formed from edges 622 and 632. In various embodiments a visible "V" is formed by edges (e.g., edges 622 and 632) of folded panels (e.g., folded panels 620 and 630), where panels 620 and 630 forming part of a larger set of folded panels (e.g., 610,620,630, and 640). Such visible "V" is formed by edges 622 and 632 being standing out of made more visible, compared to the other edges 612 and 642 of remaining folded panels 610 and 640, because these other edges 612 and 642 are de-emphasized or made less visible (compared to edges 622 and 632) by causing edges 612 and 642 to be located closer to first end 110 of smokable shell 100 (compared to edges 622 and 632 which form the visible "V"). Other de-emphasized edges of folded panels can be de-emphasized or made less visible by causing these edges to be recessed relative to visible edges 622 and 632 (e.g., causing them to be more closer to upper section 510 as edges 622 and 632) making the visible "V" when viewing the lower end of conical smoking shell 100 and lower end of reinforcing tip 500.

Such visible "V" is believed to be aesthetically pleasing to consumers and proves a means of differentiating the user's conical smoking shell 100 compared to other smoking products. The formation of reinforcing tip 500 with visible "V" will be described in more detail below under the section entitled "Particular Steps In Forming a Reinforcing Tip With A Visible "V."

Conical Smoking Shell With Reinforcing Tip Packaged For Sale In An Unfilled State Conical smoking shell 100 can be packaged for sale in an unfilled state so that its interior is not filled with smokable filler but can be filled with a users selected smokable filler.

Figure 15:
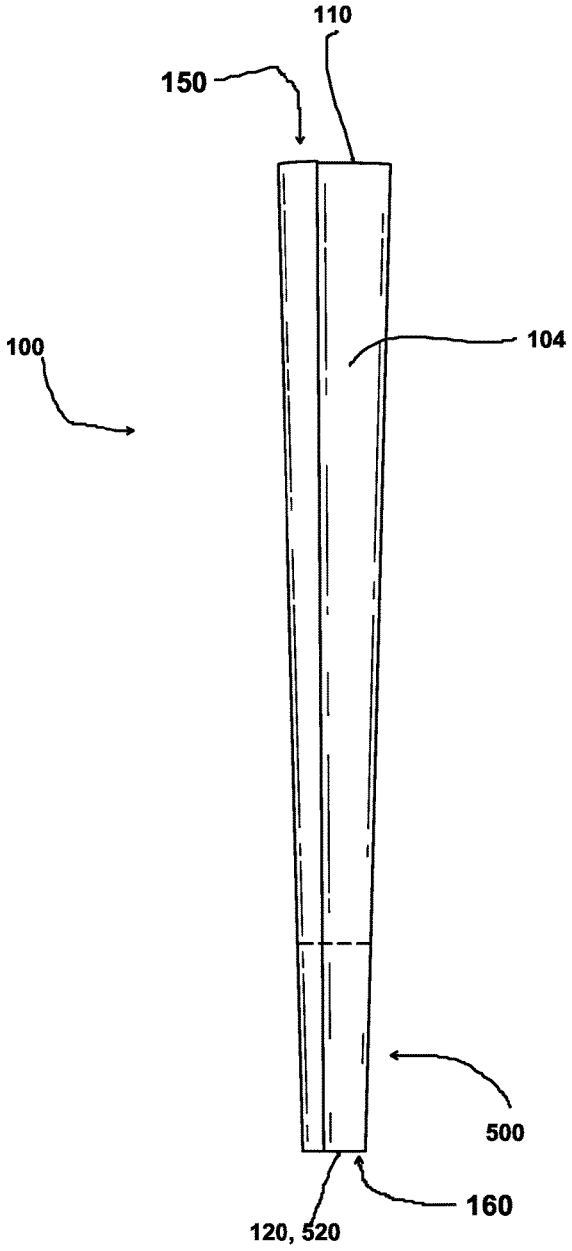
FIG. 15 is a side view of a conical smoking shell that can include any of the embodiments of the reinforcing tips with v-shaped indicators on their lower ends.
Figure 16:
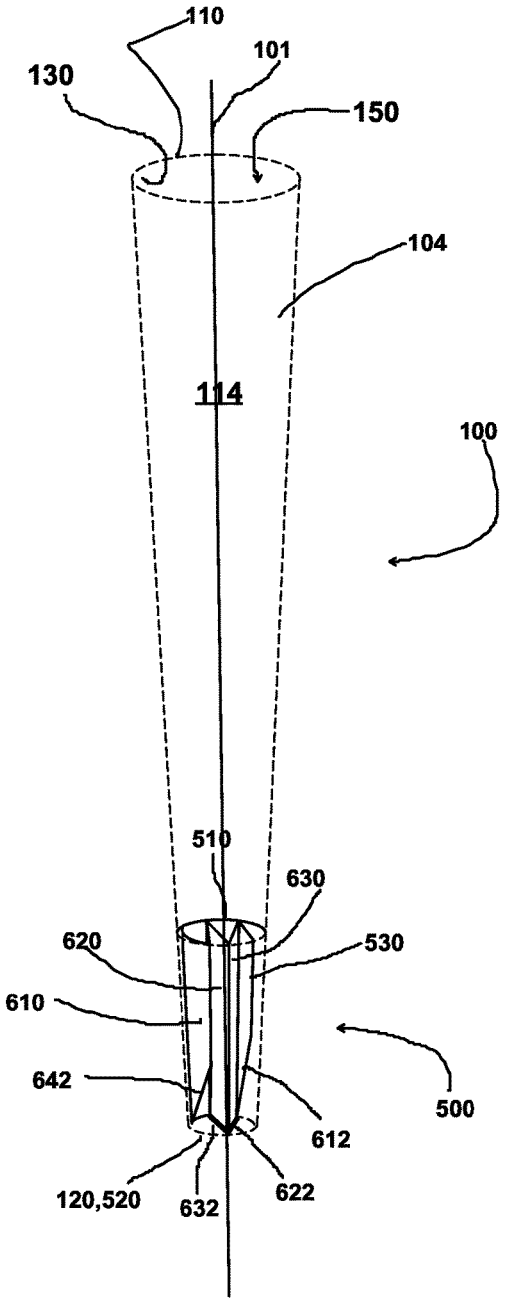
FIG. 16 is a side view of a conical smoking shell that includes the reinforcing tip of FIG. 6 where the conical smoking shell is shown in broken lines to better folded panels forming the v-shape on the bottom of the reinforcing tip.

FIG. 15 is a side view of a conical smoking shell 100 that can include any of the embodiments of the reinforcing tips 500 with visible "V"-shaped indicators on their lower ends. FIG. 16 is a side view of a conical smoking shell 100 that includes the reinforcing tip 500 of FIG. 6 where the conical smoking shell 100 is shown in broken lines to better show folded panels 620 and 630 forming the v-shape on the bottom of the reinforcing tip 500. FIG. 17 is a perspective view of the conical smoking shell 100 where the reinforcing tip 500 is schematically shown as being placed in the interior 114 of the conical smoking shell 100 and the conical smoking shell 100 itself is schematically shown as being packaged for sale in packaging 800 (such as a plastic tube or foil pouch) when conical smoking shell 100 is not filled with smokable filler material.

Package 800 can be flexible and any shape such as rectangular or conical. The package 800 has interior 830 that can be closed. The interior 830 can be sized and shaped to contain smokable cone 100. The package or wrapper 830 has closed end 810 and open end 820 that would enable insertion of the combination of cone 100 into the interior 830. A cap or seal 840 could can contain conical smoking shell in interior 830.

In various embodiments the apparatus of the present invention enables a user or smoker to support his or her custom smokable filler into hollow interior of conical smoking shell 100 after removing shell 100 from package or wrapper 800. Conical smoking shell 100 has a frustoconical shape with an opening into which custom smokable filler material can be added.

A user 5 can use rod 700 to tamp or compress the smokable material within larger section of conical smoking shell 100. In such a situation, reinforcing tip 500 of can prevent the tamped smokable filler material added from exiting the interior 114 of conical smoking shell 100. The open end 110 of conical smoking shell 100 can be wrapped, folded, and/or twisted until it is closed to form a closure.

The finished article can be smoked by placing the filter end in the user's mouth and by lighting the closure.

FIGS. 15 and 16 are perspective view of conical smoking shell 100 which can be constructed by conventional methods. Conical smoking shell 100 can include first end 110, second end 120, outer surface 140, and filter tip 180. At first end 110 can be first opening 150. At second end 120 can be second opening 160. First opening 150 can be larger than second opening 160 giving conical smoking shell 100 its conical shape. Between first end 110 and second end 120 is interior portion 114 which includes inner surface 130. FIG. 16 shows one embodiment of reinforcing tip 500 fully rolled and located in conical smoking shell 100.

General Steps In Forming Reinforcing Tip

Figure 1:
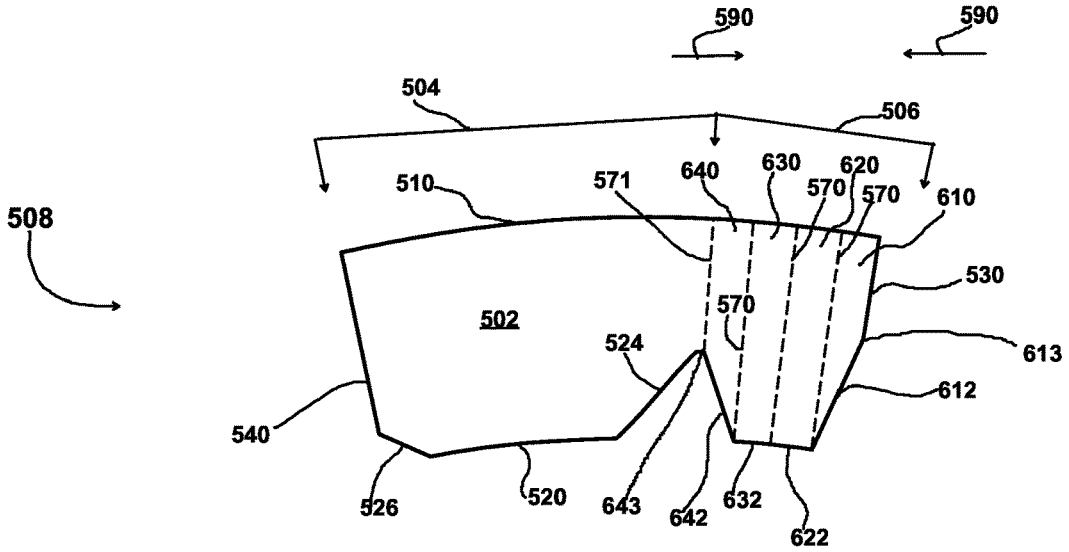
FIG. 1 is a top view of a sheet that can be formed into a reinforcing tip.
Figure 2:
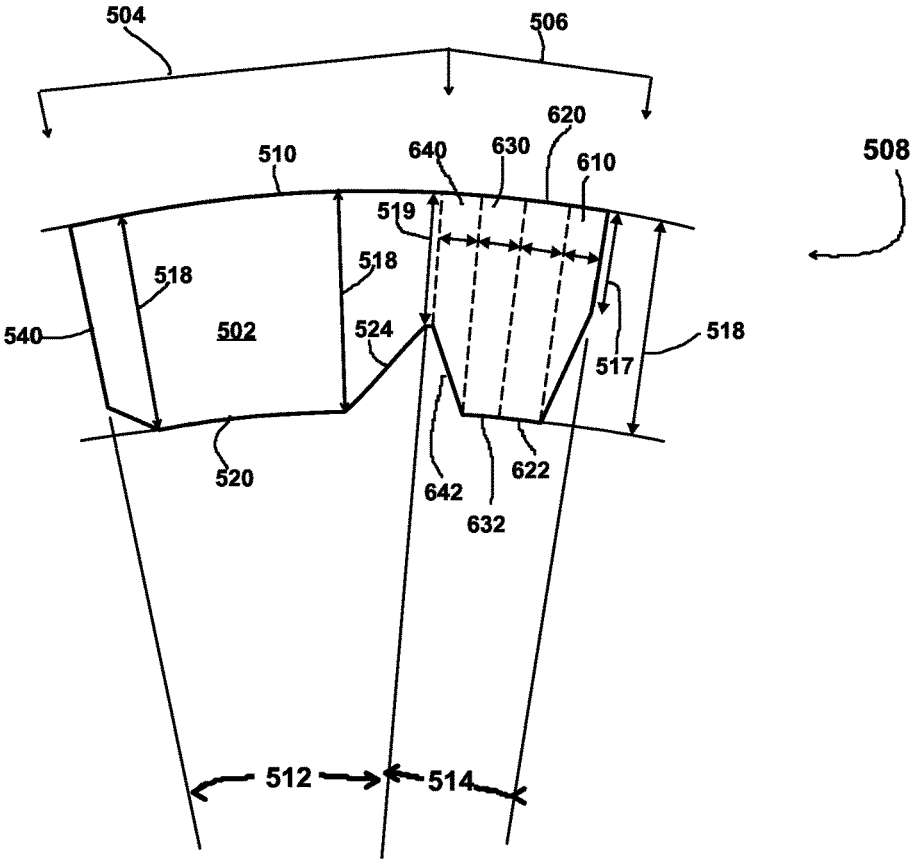
FIG. 2 is a top view of the sheet of FIG. 1 with first and second sections between first and second ends where the first and second ends fall on circumferences of first and second circles.

Reinforcing tip 500 can be formed from a semi-circular sheet of material 508. FIGS. 1 and 2 are top views of a sheet of material 508 shown flat. When flat, sheet of material 508 can include first section 504 (falling within projected angle 512), second section 506 (falling within projected angle 514), first end 510, second end 520, first edge 530, second edge 540, first face 502, and second face 503.

Second section 506 can include a plurality of fold lines 570 which can be perforated, weakened, lined, etched or pre-folded. First section 504 can provide external support when rolled around second section 506.

In forming conical reinforcing tip 500, second section 506 (falling within projected angle 514) of sheet 508 can be folded upon itself (such as by using perforation or fold lines 570 to assist in the folding and schematically indicated by arrow 590). Second section 506 can be placed between a user's thumbs and forefingers and is folded alternatively (or in an undulating manner) toward first perforation or etched line 571. The number of times that second section 506 of sheet of material 508 can be folded upon itself depends both on angle 514 and the number of fold lines 570 (e.g., the distance between fold lines 570).

Generally, after the folding of second section 506, first section 504 is rolled about the "previously folded" second section 506 (schematically indicated by arrow 590) until reinforcing tip 500 is formed as schematically shown in FIGS. 3 through 7.

Figure 3:
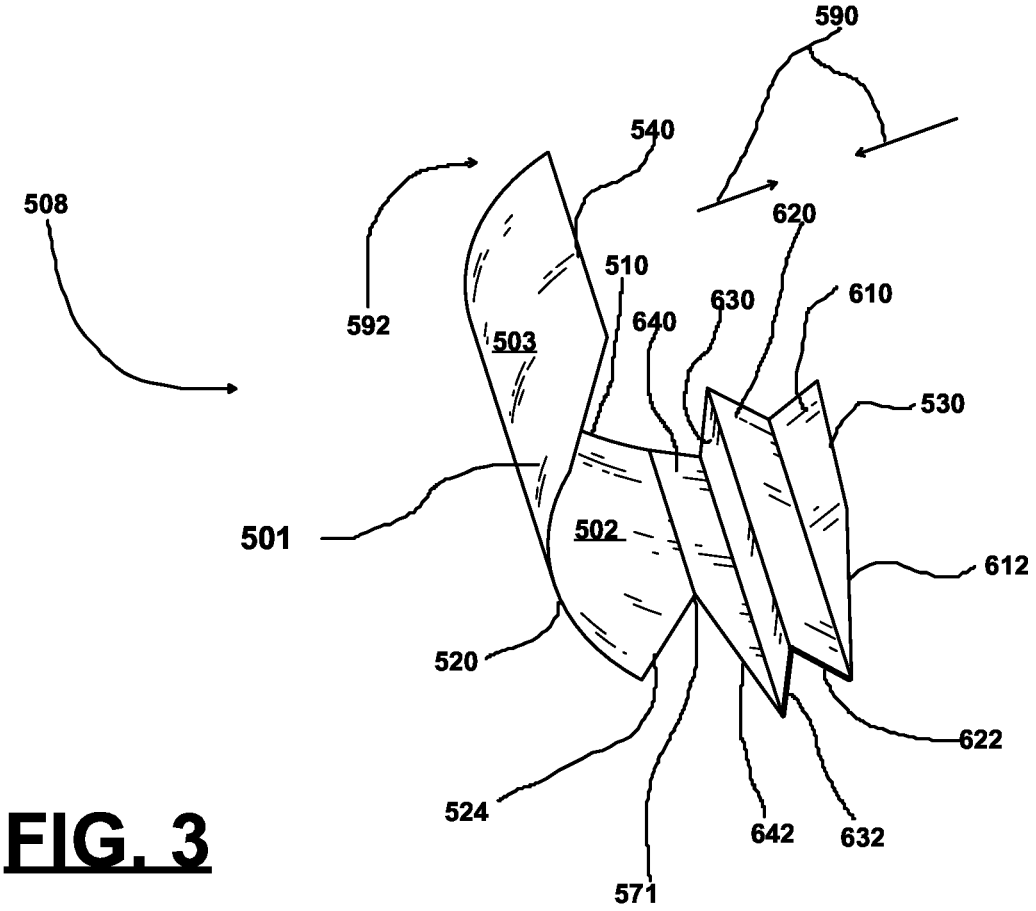
FIG. 3 is a perspective view of the sheet of FIG. 1 now with particular panels of the second section folded and starting the process of forming or rolling the first section of the sheet around the folded panels for forming reinforcing tip.
Figure 4:
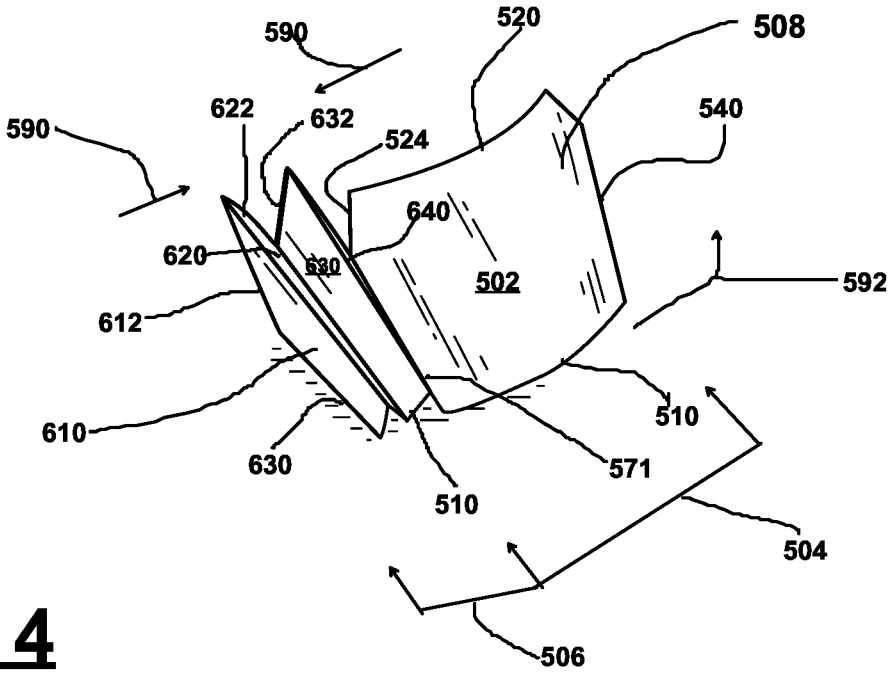
FIG. 4 is a perspective view of the partially rolled reinforcing tip of FIG. 3 but rotating 180 degrees to better show the opposite sides of the folded panels.

Reinforcing tip 500 can be constructed by both folding second section 506 (from first edge 530 using plurality of fold lines 570) and rolling first portion 504 (from second edge 540) into a hollow cone shape. FIGS. 3 and 4 are perspective views of the reinforcing tip 500 shown being fabricated with the folding of a plurality of transversely oriented panels via fold lines 570 and the support beginning to be rolled.

Figure 5:
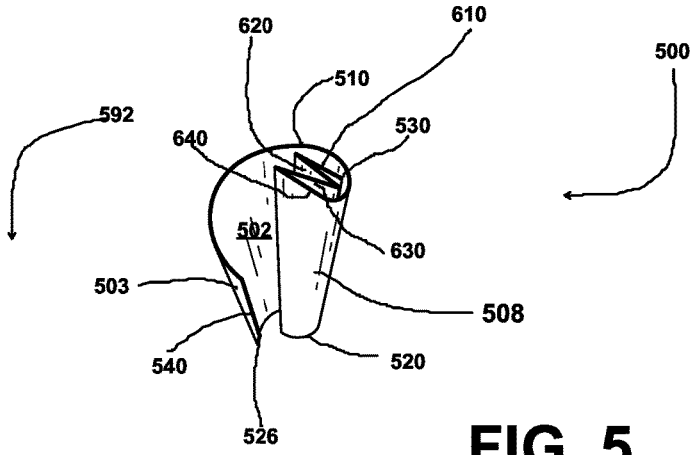
FIG. 5 is a top perspective view of the sheet of FIG. 3 where the first section has been further rolled about the folded panels in forming the reinforcing tip.
Figure 6:
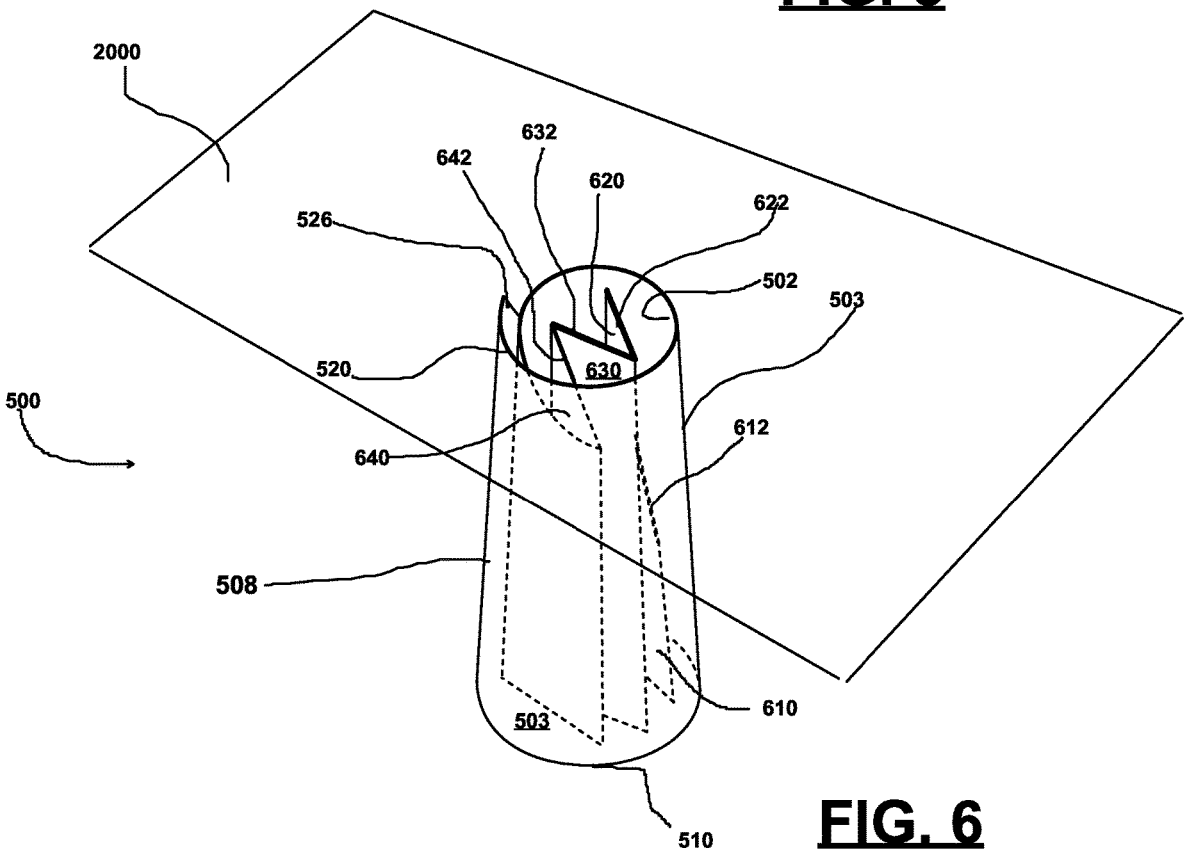
FIG. 6 is a side perspective view of the sheet of FIG. 3 shown near the completion of the rolling process in forming a reinforcing tip and with the bottom of the reinforcing tip positioned upwardly to show the bottom edges of two of the folded panels forming a "V-shape".
Figure 7:
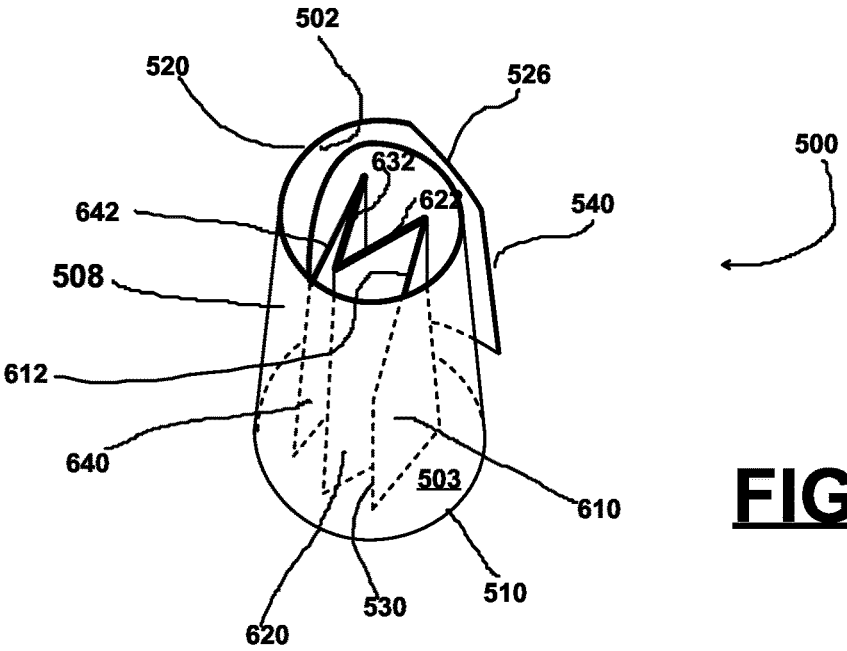
FIG. 7 is a top perspective view of the partially rolled reinforcing tip of FIG. 6 where the reinforcing tip has been rotated about its longitudinal axis to show the edges of the additional panels that do not form the "V-shape."

FIG. 5 is a top perspective view of the reinforcing tip of FIG. 4 shown with a plurality of transversely oriented panels 574 and the second portion 508 or outer support being rolled to form a frustoconical perimeter. FIG. 6 is a bottom perspective view of reinforcing tip 500 shown with a plurality of transversely oriented panels 574 and the remainder of second portion 508 being rolled to form a frustoconical perimeter. FIG. 7 is a perspective view of the second portion 508 or outer support of the filter tip 500 shown fully rolled.

At first end 510 can be first opening 512. At second end 520 can be second opening 522. First opening 512 can be larger than second opening 522 giving inner support 500 its conical shape. Between first end 510 and second end 520 is interior portion 514 which includes the plurality of folds 570, which plurality of folds resist flattening of the conical shape of inner support 500.

Sheet of material 508 can have a thickness greater than the thickness of sidewall 102 of cone 100. Sheet of material 508 for filter tip 500 can be pliable and deformable material, such as paper, plastic, metal and the like, that is capable of retaining a folded and spiral shape when folded and then rolled upon itself from one end. In a preferred embodiment, the filter tip 500 can be formed from a material is relatively less flammable than cone side wall 104 and/or the smokable filler so that when all of the smokable filler material has been consumed the smokable article becomes extinguished.

Particular Steps In Forming a Reinforcing Tip With A Visible "V"

FIG. 17 is a perspective view of a conical smoking shell 100 where the reinforcing tip 500 includes an emphasized or visible "V" formed from edges 622 and 632. In various embodiments a visible "V" is formed by edges 622 and 632 of folded panels 620 and 630 forming par of a larger set of folded panels (e.g., 610,620,630, and 640). Such visible "V" is formed by edges 622 and 632 being emphasized or made more visible compared to the other edges 612 and 642 of remaining panels 610 and 640 which other edges 612 and 642 are de-emphasized or made less visible (compared to edges 622 and 632) by located edges 612 and 642 closer to first end 110 of smokable shell 100 compared to edges 622 and 632 which form the visible "V".

FIGS. 1 through 7 show one embodiment of a sheet 501 which can be used to make a reinforcing tip having a visible "V".

FIGS. 1 and 2 are top views of a sheet of material 508 shown flat. When flat, sheet of material 508 can include first section 504 (falling within projected angle 512), second section 506 (falling within projected angle 514), first end 510, second end 520, first edge 530, second edge 540, first face 502, and second face 503. Second section 506 can include panels 610, 620, 630, and 640. In this embodiment four (4) panels are shown but additional panels can be used. In one embodiment three panels 620, 630, and 640 are use, however, this embodiment is not preferred as it is believed that additional panel(s) 610, etc. will help maintain the "V" shape for edges 622 and 632 when formed into reinforcing tip 500.

To emphasize or make visible edges 622 and 632 of panels 620 and 630, all remaining edges of the remaining panels (e.g., edges 612 and 642 of panels 610 and 640) can be de-emphasized. Edges 612 and 642 are de-emphasized by having them be located closer to upper or first end 510 of sheet 508. In FIGS. 1 and 2 this is done be having edges 612 and 642 angled towards first end 510 so that they are not located at second end 520 as edges 622 and 632 of panels 620 and 630. It is noted that both edges 612 and 642 terminate at second end 520 but such is only at a single point and does not significantly impact the "V" which is visible from edges 622 and 632 which edges are completely contained at second end 520.

It is noted in FIGS. 1 and 2 that the termination points 613 and 643 of edges 612 and 642 are not located at the same vertical level between first end 510 and second end 520. It is not believed for such to be necessary and in an alternative embodiment termination points 613 and 643 can be located at the same vertical level between first end 510 and second end 520.

FIGS. 3-7 schematically show the steps in forming reinforcing tip 500 from sheet 508. FIG. 3 is a perspective view of sheet 508 now with particular panels 610, 620, 630, and 640 folded and being rolled into a reinforcing tip 500. FIG. 4 is a perspective view of the partially rolled reinforcing tip 500 turned over to show the opposite side of the partially rolled reinforcing tip. Arrows 590 schematically indicate the folding of panels 610, 620, 630, and 640 in second section 506 of sheet 508. Arrow 592 schematically indicates the rolling of first section 504 around the now folded panels 610, 620, 630, and 640. Edges 622 and 632 of panels 620 and 630 are bolded to emphasis that these edges will form the visible "V" in reinforcing tip 500.

FIG. 5 is a top perspective view of the sheet 508 shown further on in the rolling process. FIG. 6 is a side perspective view of sheet 508 shown near the completion of the rolling process in forming a reinforcing tip 500 and with the bottom (second end 520) of the reinforcing tip 500 positioned upwardly. FIG. 7 is a top perspective view of the partially rolled reinforcing tip 500. The visible "V" created by edges 622 and 632 of panels 620 and 630 are best seen in FIGS. 6 and 7. In FIG. 6 plane 2000 is shown where edges 622 and 632 are contained in plane 2000 but edges 612 and 642 are not contained in plane 2000. Although second end 520 of first portion 504 may also be contained in plane 1000 such does not diminish the visible "V" formed by edges 622 and 632 because edges 622 and 632 are spaced apart from such second end 520 of first portion 504. In such a case a user may see a visible "V" encased by a circle.

On the other hand, as can be seen in FIG. 5, none of the edges on the top of folded panels 610, 620, 630, and 640 have been de-emphasized cause these four top edges to form a visible "M" or "W" (e.g., each of the top edges can be contained in a single plane), while at the same time as shown by FIG. 6, lower edges 622 and 632 at the lower end of reinforcing tip 500 form a visible "V" because the other edges 612 and 642 of the folded panels have been de-emphasized by not capable of being in a single plane 2000.

As can be seen in FIGS. 6 and 17, lower edges 622 and 632 form a visible "V" as being emphasized when located in a single plane 2000 compared to the remaining edges 612 and 642 of the set of folded panels 610, 620, 630, and 640. In addition to the visible "v" formed by edges 622 and 632, a visible circle is formed by lower end 520 of reinforcing tip 500. In such a case the visible "v" formed by edges 622 and 632 is contained within the visible circle formed by lower end 520 of reinforcing tip 500. Additionally, the visible "v" in reinforcing tip 500 formed by edges 622 and 632 can be spaced apart from (not in contact with) the visible circle formed by lower end 520 of first section 504 rolled about the plurality of folded panels because the folded panels 610 and 640 (with non-emphasized edges 612 and 642) tend to push folded panels 620 and 630 (with emphasized edges 622 and 632) away from rolled first section 504 and the visible circle formed by lower end 520 of this rolled first section 504.

Figure 8:
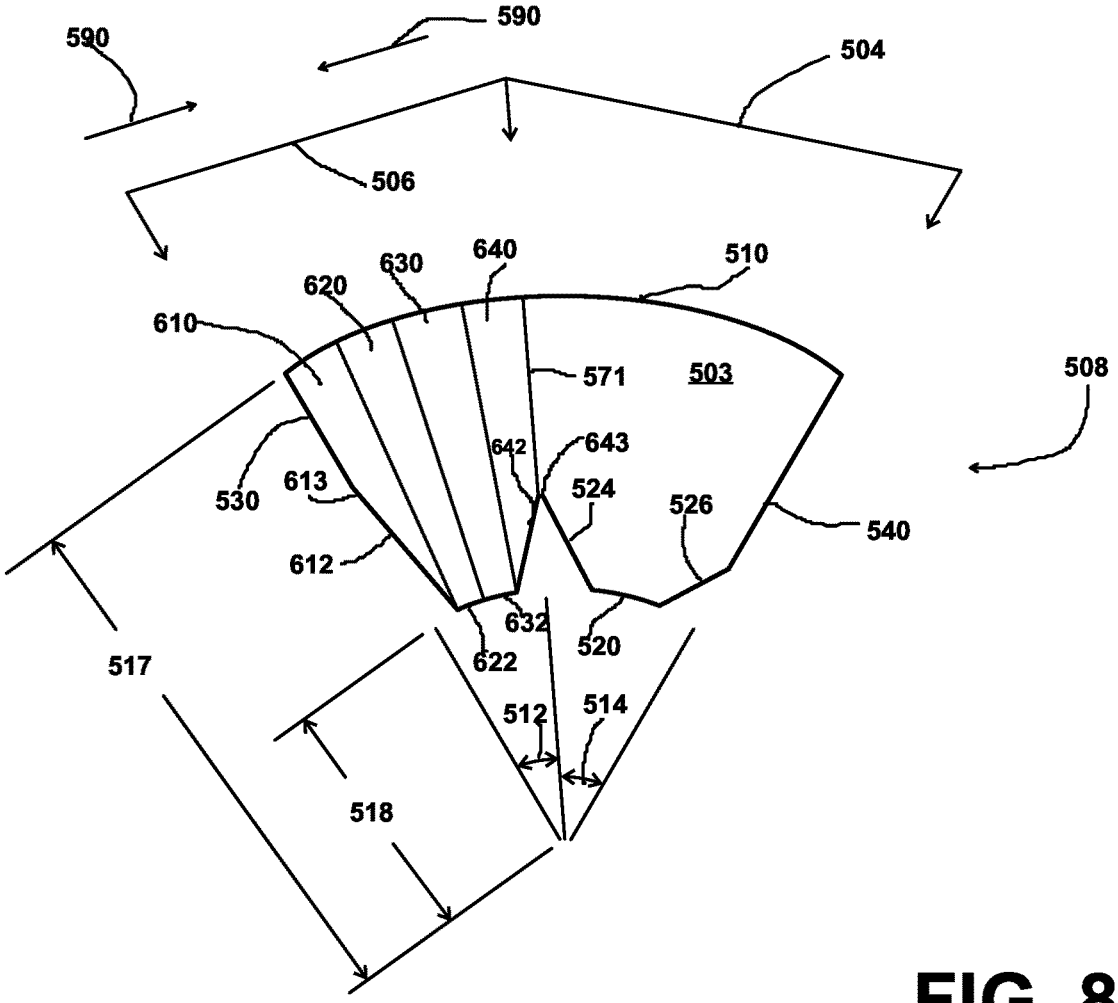
FIG. 8 is a top view of another embodiment of a sheet that can be formed into a reinforcing tip.
Figure 9:
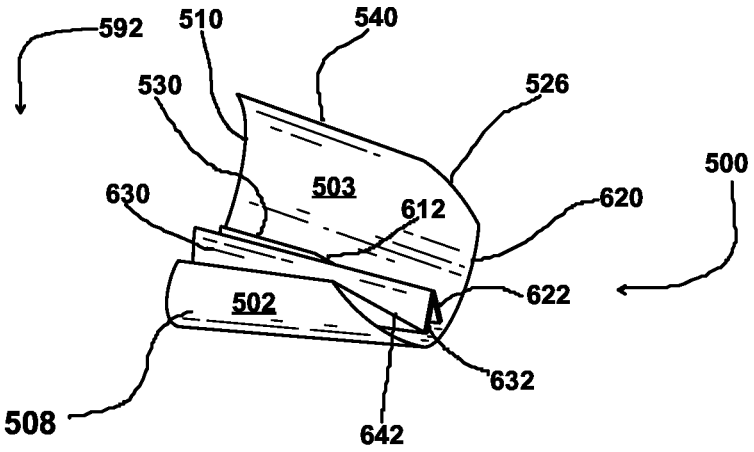
FIG. 9 is a side perspective view of the sheet of FIG. 8 now with particular panels folded and being rolled into a reinforcing tip.
Figure 10:
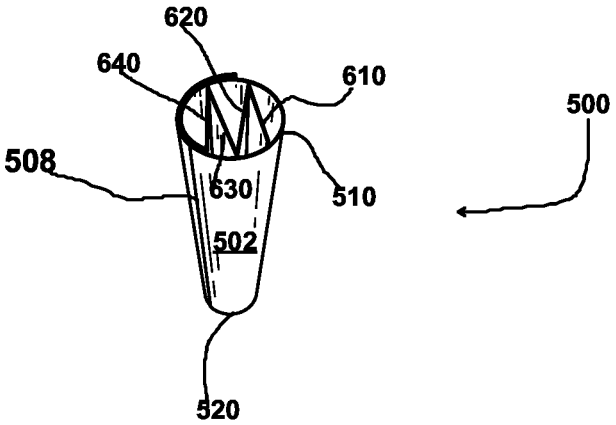
FIG. 10 is a top perspective view of the sheet of FIGS. 7 and 8 shown after the completion of the rolling process in forming a reinforcing tip and with the top of the reinforcing tip positioned upwardly.

FIGS. 8-10 schematically show the steps in forming another embodiment of reinforcing tip 500 from another embodiment of sheet 508. In this embodiment, while first section 504 is on the right hand side while second section is on the left hand side compared to sheet 508 shown in FIG. 1. Additionally, the relative sizes of first section 504 and second section 506 are also different compared to those in FIG. 1. FIG. 9 is a side perspective view of the sheet 508 of FIG. 8 now with particular panels 610, 620, 630, and 640 folded and first section 504 being rolled into a reinforcing tip 500 (schematically indicated by arrow 592). FIG. 10 is a top perspective view of the sheet 508 shown after the completion of the rolling process in forming a reinforcing tip 500 and with the top of the reinforcing tip 500 positioned upwardly. FIG. 10 shows how the top edges of panels 610, 620, 630, and 640 form an "M" or "W" instead of a "V" because the top edges of panels 610 and 640 have not been "de-emphasized" compared to the top edges of panels 620 and 630. On the other hand, as can be seen in FIG. 9, edges 622 and 632 on the bottom of reinforcing tip 500 do form a "V" as edges 612 and 642 on the bottom have been de-emphasized. In this case the top of reinforcing tip shows a visible "M" or "W" where the bottom shows a visible "V."

Figure 11:
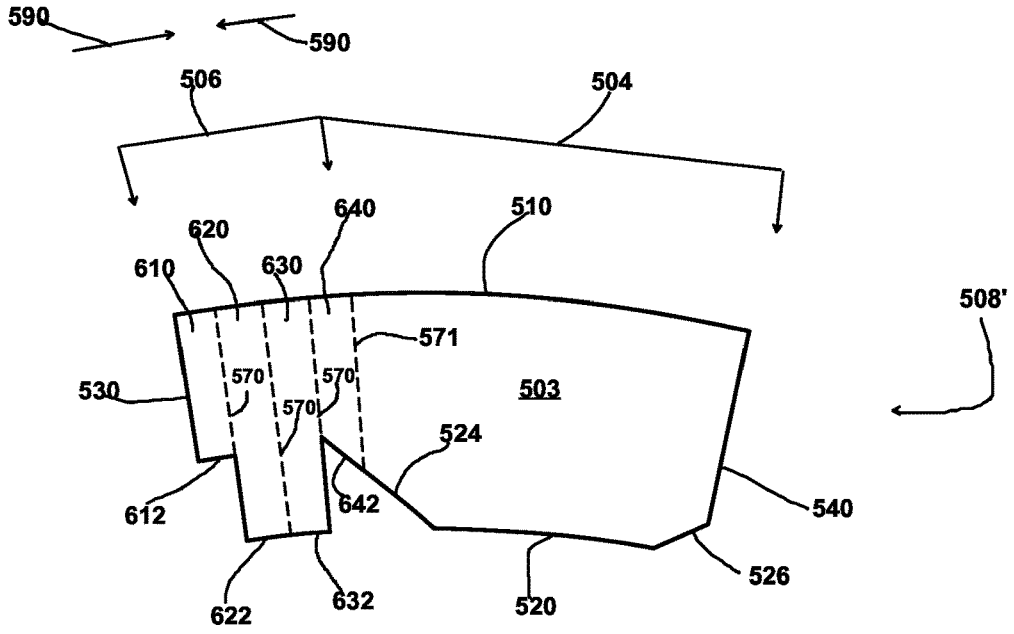
FIG. 11 is a top view of another embodiment of a sheet that can be formed into a reinforcing tip.
Figure 12:
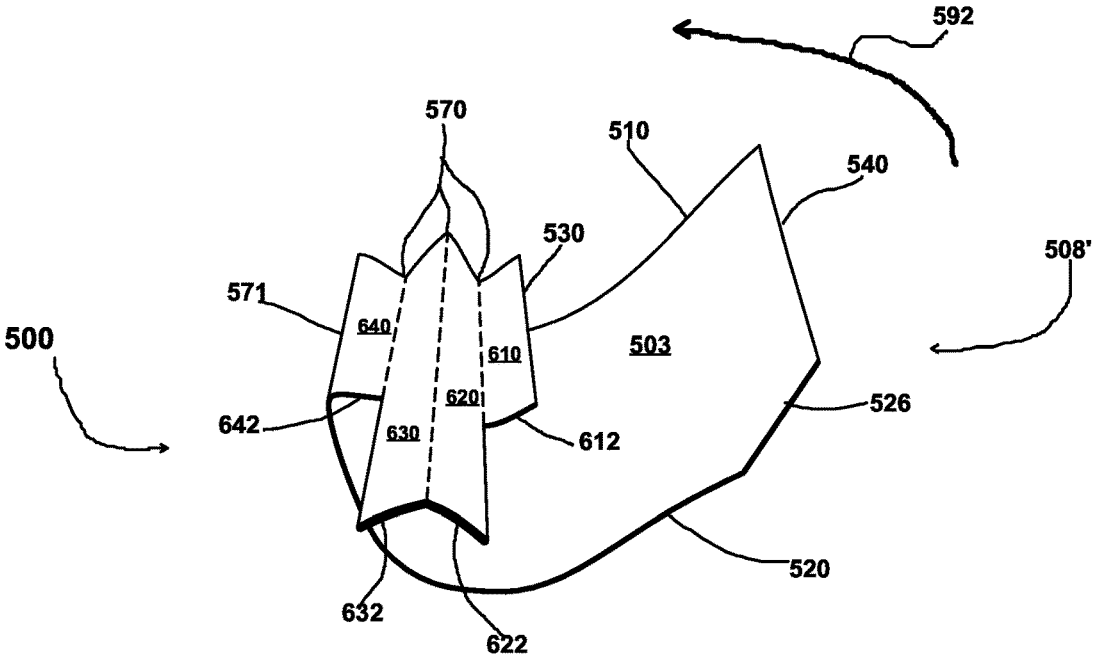
FIG. 12 is a bottom perspective view of the sheet of FIG. 11 now with particular panels folded and shown in the initial stages of being rolled into a reinforcing tip.
Figure 13:
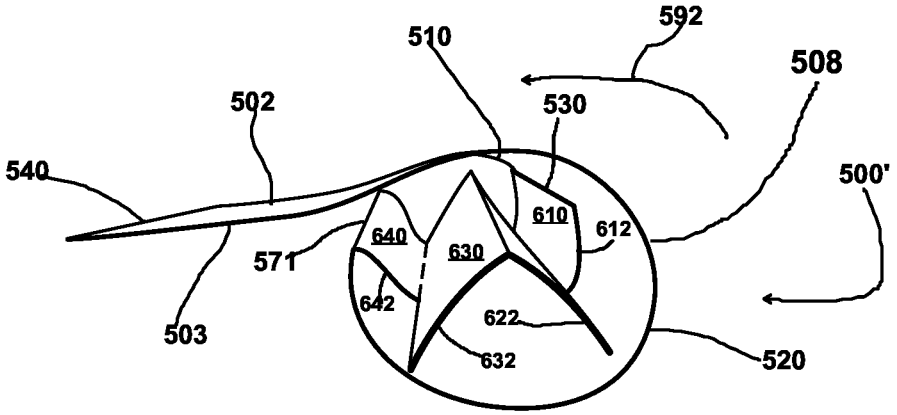
FIG. 13 is a bottom perspective view of the partially rolled reinforcing tip of FIG. 12 but now shown in later stages of being rolled into a reinforcing tip.
Figure 14:
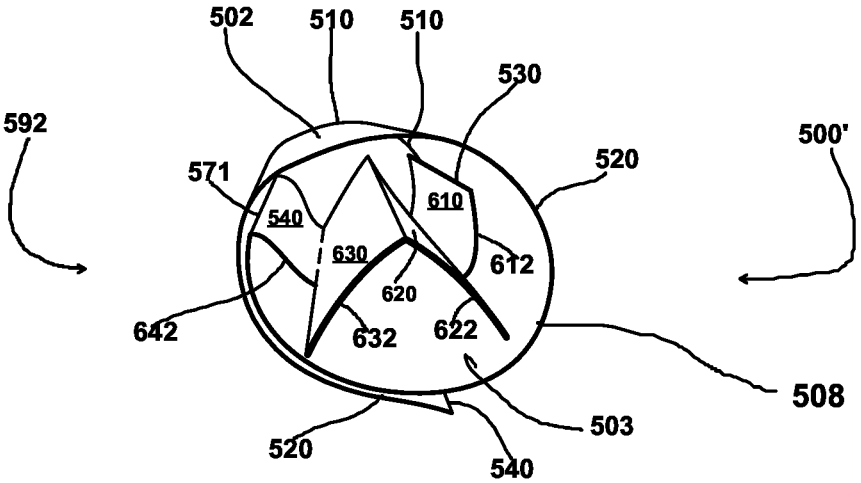
FIG. 14 is a bottom perspective view of the partially rolled reinforcing tip of FIG. 12 but now shown in the final stages of being rolled into a reinforcing tip.

FIGS. 11-14 schematically show the steps in forming a reinforcing tip 500 from another embodiment of sheet 508. FIG. 11 is a top view of another embodiment of a sheet 508 that can be formed into a reinforcing tip 500. FIG. 12 is a bottom perspective view of the sheet 508 of FIG. 11 now with particular panels 610, 620, 630, and 640 folded and shown in the initial stages of being rolled into a reinforcing tip 500. FIG. 13 is a bottom perspective view of the partially rolled reinforcing tip 500 of FIG. 12 but now shown in later stages of being rolled into a reinforcing tip 500. FIG. 14 is a bottom perspective view of the partially rolled reinforcing tip 500 of FIG. 12 but now shown in the final stages of being rolled into a completed reinforcing tip 500.

In this embodiment, both edges 612 and 642 of sheet 508 are vertically spaced apart from and do not connect with second end 520 and/or edges 622 and 632 (and edges 612 and 642 are both located closer to first end 510 compared to edges 622 and 632). Vertically spacing apart edges 612 and 642 provides another option for emphasizing edges 622 and 632 in forming the visible "V" to de-emphasize the visibility of edges 612 and 642. As can be seen in FIG. 14, edges 622 and 632 in reinforcing tip are contained in a single plane while edges 612 and 642 will not be contained in the same plane that contains edges 622 and 632. As can be seen in FIG. 11 before folding edge 612 can be parallel to edges 622 and 632, while edge 642 in not parallel to either edge 612 or edges 622 and 632, so that when reinforcing tip 500 is constructed from sheet 508 of FIG. 11, a plane that contains edge 612 would be parallel to a plane containing edges 622 and 632, but a plane that contains edge 642 could not be parallel to either the plane that contains edges 622 and 632 or the plane that contains edge 612. In an alternative embodiment edge 642 could be parallel to edge 612 and located closer to first end 510 than edges 622 and 632.

The following is a Table of Reference Numerals used in this patent application:

TABLE OF REFERENCE NUMERALS:

| REFERENCE NUMBER | DESCRIPTION |
|---|---|
| 10 | smoking article |
| 100 | hollow cone |
| 101 | longitudinal centerline |
| 104 | sidewall |
| 110 | first end |
| 114 | interior |
| 120 | second end |
| 130 | inner surface |
| 140 | outer surface |
| 150 | first opening |
| 160 | second opening |
| 180 | filter |
| 400 | sheet of material |
| 402 | first side |
| 402 | second side |
| 410 | first end |
| 420 | second end |
| 430 | first edge |
| 440 | second edge |
| 460 | tab or lip |
| 490 | arrow |
| 492 | arrow |
| 500 | reinforcing tip |
| 501 | sheet of material |
| 502 | first face |
| 503 | second face |
| 504 | first section |
| 506 | second section |

-continued

TABLE OF REFERENCE NUMERALS:

| REFERENCE NUMBER | DESCRIPTION |
|---|---|
| 508 | sheet |
| 510 | first end |
| 511 | upper perimeter |
| 512 | first angle |
| 514 | second angle |
| 517 | dimension |
| 518 | dimension |
| 519 | dimension |
| 520 | second end |
| 522 | lower perimeter |
| 524 | edge |
| 526 | edge |
| 530 | first side |
| 540 | second side |
| 560 | tab or lip |
| 570 | plurality of perforation lines, lines, or etched areas |
| 571 | first perforation line or etched area |
| 590 | arrows |
| 592 | arrow |
| 600 | plurality of transverse panels |
| 610 | first transversely oriented panel |
| 612 | tapered edge |
| 613 | termination point |
| 620 | second transversely oriented panel |
| 622 | edge |
| 630 | third transversely oriented panel |
| 632 | edge |
| 640 | fourth transversely oriented panel |
| 642 | tapered edge |
| 643 | termination point |
| 576 | tips of select two transversely oriented panels |
| 577 | vertex |
| 580 | select two of transversely oriented panels |
| 590 | arrow |
| 597 | arrow |
| 598 | arrow |
| 700 | straw or tamper |
| 800 | package/wrapper |
| 802 | arrow |
| 810 | closed end |
| 820 | open end |
| 830 | interior |
| 840 | seal |
| 900 | tamper |
| 902 | arrow |
| 910 | first end |
| 920 | second end |
| 2000 | plane |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A smoking product comprising:

(a) a conical smoking sheet having upper and lower conical ends and a conical interior;

(b) a reinforcing sheet having first and second sections, wherein the first section is rolled with top and bottom portions, and having a reinforcing tip interior and a longitudinal centerline;

(c) the second section is located in the reinforcing tip interior and includes at least four folded panels, each of the at least four folded panels having top and bottom panel edges, wherein a first two of the at least four folded panels are both directly attached to each other and have bottom panel edges which are both substantially perpendicular to the longitudinal centerline and located substantially at a first vertical level, wherein a second two of the at least four folded panels which are not the first two of the at least four folded panels satisfy at least one of the following conditions:

(1) having bottom panel edges that are not substantially perpendicular to the longitudinal centerline;

(2) having bottom panel edges which are both not located substantially at the first vertical level; and (3) having one bottom panel edge that is not substantially perpendicular to the longitudinal centerline and another bottom panel edge which is not located at the first vertical level;

(d) the reinforcing sheet forming a reinforcing tip and being located in the conical interior and forming a conical smoking product, the conical smoking product being packaged for sale while being unfilled with a smokable filler, wherein bottom panel edges of the first two of the at least four folded panels form a V-shape which is clearly visibly distinguishable compared to the bottom edges of the remainder of the at least four folded panels.

2. The smoking product of claim 1, wherein first section forms a closed conical shape with a lower circular edge, the second section has at most four folded panels, and the bottom panel edges of the first two of the at least four folded panels are not in contact with the first section.

3. The smoking product of claim 1, wherein the first section includes first and second side edge portions, and is rolled so that the first side edge portion overlaps and extends over the second side edge portion to for a closed conical shape.

4. The smoking product of claim 3, wherein the first section has a length and a height, and at least 25 percent of the length overlaps and extends over the second side edge portion.

5. The smoking product of claim 3, wherein the first section has a length and a height, and at least 50 percent of the length overlaps and extends over the second side edge portion.

6. The smoking product of claim 1, wherein the bottom panel edges of the second two of the at least four folded panels are not located at the first vertical level.

7. The smoking product of claim 1, wherein the bottom panel edges of the second two of the at least four folded panels are located in a common plane.

8. The smoking product of claim 1, wherein the bottom panel edges of the second two of the at least four folded panels are located in a common plane that is perpendicular to the longitudinal centerline.

9. The smoking product of claim 1, wherein the bottom panel edges of the second two of the at least four folded panels are located in a common plane that is skewed in relation to the longitudinal centerline.

10. A smoking product comprising:

(a) a conical smoking sheet having upper and lower conical ends and a conical interior;

(b) a reinforcing sheet having first and second sections, wherein the first section is rolled with top and bottom portions, and having a reinforcing tip interior and a longitudinal centerline;

(c) the second section is located in the reinforcing tip interior and includes at least four folded panels, each of the at least four folded panels having top and bottom panel edges, wherein a first two of the at least four folded panels are both directly attached to each other and have bottom panel edges which are both substantially perpendicular to the longitudinal centerline and located substantially at a first vertical level, wherein a second two of the at least four folded panels which are not the first two of the at least four folded panels satisfy at least one of the following conditions:

(1) having bottom panel edges that are not substantially perpendicular to the longitudinal centerline;

(2) having bottom panel edges which are both not located substantially at the first vertical level; and (3) having one bottom panel edge that is not substantially perpendicular to the longitudinal centerline and another bottom panel edge which is not located at the first vertical level;

(d) wherein bottom panel edges of the first two of the at least four folded panels form a V-shape; and (e) the reinforcing sheet forming a reinforcing tip and being located in the conical interior and forming a conical smoking product, the conical smoking product being packaged for sale while being unfilled with a smokable filler.

11. The smoking product of claim 10, wherein first section forms a closed conical shape and the second section has at most four folded panels.

12. The smoking product of claim 10, wherein the first section includes first and second side edge portions, and is rolled so that the first side edge portion overlaps and extends over the second side edge portion to for a closed conical shape.

13. The smoking product of claim 12, wherein the first section has a length and a height, and at least 25 percent of the length overlaps and extends over the second side edge portion.

14. The smoking product of claim 12, wherein the first section has a length and a height, and at least 50 percent of the length overlaps and extends over the second side edge portion.

15. The smoking product of claim 10, wherein the bottom panel edges of the second two of the at least four folded panels are not located at the first vertical level.

16. The smoking product of claim 10, wherein the bottom panel edges of the second two of the at least four folded panels are located in a common plane.

17. The smoking product of claim 10, wherein the bottom panel edges of the second two of the at least four folded panels are located in a common plane that is perpendicular to the longitudinal centerline.

18. The smoking product of claim 10, wherein the bottom panel edges of the second two of the at least four folded panels are located in a common plane that is skewed in relation to the longitudinal centerline.

19. A packaged smoking apparatus that generates a smokable article, comprising:

a) a package having a package interior and an end portion with a sealed opening;

b) a smokable cone being hollow with a cone interior and cone sidewall;

c) a reinforcing tip having a tip interior, the reinforcing tip occupying a position within the cone interior, the reinforcing tip having a stiffness that is greater than the stiffness of the cone sidewall;

d) wherein, the reinforcing tip has a plurality of transversely oriented panels forming a plurality of pathways through the tip interior;

e) wherein, each of the panels in the plurality of transversely oriented panels have upper and lower panel edges, wherein the upper panel edges of each of the plurality of transversely oriented panels being substantially located in a common upper plane, and further two of the plurality of transversely oriented panels immediately adjacent each other having lower panel edges being substantially located in a common lower plane and the lower panel edges forming a main V-shape, and further at least one other of the plurality of transversely oriented panels having a lower panel edge not substantially located in the common lower plane;

f) wherein the smokable cone is packaged for sale inside the package interior as an assembly.

20. The packaged smoking apparatus of claim 19, wherein the reinforcing tip includes at least 4 transversely oriented panels which are connected to each other in series at a plurality of spaced apart vertices and only two of the at least 4 transversely oriented panels have lower panel edges that are substantially located in the common lower plane.

21. The packaged smoking apparatus of claim 19, wherein the reinforcing tip includes at least 5 transversely oriented panels which are connected to each other in series at a plurality of spaced apart vertices and only two of the at least 4 transversely oriented panels have lower panel edges that are substantially located in the common lower plane.

22. The packaged smoking apparatus of claim 19, wherein the reinforcing tip includes at least 6 transversely oriented panels which are connected to each other in series at a plurality of spaced apart vertices and only two of the at least 4 transversely oriented panels have lower panel edges that are substantially located in the common lower plane.

23. The packaged smoking apparatus of claim 19, wherein the at least one other of the plurality of transversely oriented panels having a lower panel edge substantially located in a first medial plane that is parallel to the common lower plane and spaced between the common upper plane and common lower plane.

24. The packaged smoking apparatus of claim 19, wherein the at least one other of the plurality of transversely oriented panels having a lower panel edge substantially located in a second medial plane that intersects both the common lower plane and the common upper plane and common lower plane.

25. The packaged smoking apparatus of claim 19, wherein the at least one other of the plurality of transversely oriented panels having a lower panel edge substantially located in a first medial plane that is parallel to the common lower plane and spaced between the common upper plane and common lower plane, and at least one other of the plurality of transversely oriented panels having a lower panel edge substantially located in a second medial plane that intersects both the common lower plane and the common upper plane and common lower plane.

26. The packaged smoking apparatus of claim 19, wherein the at least one other of the plurality of transversely oriented panels having a lower panel edge substantially located in a first medial plane that is parallel to the common lower plane and spaced between the common upper plane and common lower plane, and at least one other of the plurality of transversely oriented panels having a lower panel edge substantially located in a second medial plane that is parallel to and spaced apart from the first medial plane.

27. The packaged smoking apparatus of claim 19, wherein the at least one other of the plurality of transversely oriented panels includes at least two panels having lower panel edges substantially located in a first medial plane that is parallel to the common lower plane and spaced between the common upper plane and common lower plane.

* * * * *